United States Patent [19]

Green

[11] Patent Number: 4,484,740

[45] Date of Patent: Nov. 27, 1984

[54] WEIGHT TRAINING DEVICE

[76] Inventor: Tom M. Green, 41-A E. First Ave., Dugway, Utah 84022

[21] Appl. No.: 378,773

[22] Filed: Mar. 17, 1982

[51] Int. Cl.[3] ..... A63B 21/12

[52] U.S. Cl. ..... 272/119; 272/122

[58] Field of Search ..... 272/119, 123, 124, 143, 272/93, 67

[56] References Cited

U.S. PATENT DOCUMENTS

| | | | |
|---|---|---|---|
| 4,039,183 | 8/1977 | Sakurada | 272/67 |
| 4,109,908 | 8/1978 | Pugh et al. | 272/119 |
| 4,312,506 | 1/1982 | Brennan | 272/123 |
| 4,327,908 | 5/1982 | James | 272/119 |

*Primary Examiner*—Richard J. Apley
*Assistant Examiner*—William R. Browne
*Attorney, Agent, or Firm*—Trask & Britt

[57] ABSTRACT

A weight training device includes a splint-like member adapted to be attached to the underside of the forearm of a person engaged in exercising with training weights. The splint-like member extends from a point sufficiently below the elbow to permit flexing of the arm to a point in the palm of the hand. Structures are provided for attaching the splint-like member to the forearm and for attaching a training weight, such as a dumbbell or barbell, at the wrist section of the splint-like member. The splint-like member is curved upwardly at the palm end so as to provide a grip for the fingers.

5 Claims, 3 Drawing Figures

WEIGHT TRAINING DEVICE

BACKGROUND OF THE INVENTION

1. Field of the Invention

The present invention relates generally to a device for physical fitness training. More particularly, the present invention relates to the improvement of physical fitness in general, and body development in particular, by weight training. Still more particularly, the present invention relates to an improved weight training device for use in conjunction with dumbbells and barbells.

2. Description of the Prior Art

The practice of exercising the body by means of weight training, both for its health and esthetic values, as well as for preparation for competition in the sports of weight lifting and body building, has long been followed by some athletes. More recently, the benefits and advantages of weight training as preparation for competition in sports other than weight lifting and body building have been recognized by professional coaches and trainers who now include weight training in their training programs whatever the sport and whatever the level of competition. At about the same time that the values of weight training were being recognized for the specialized athlete, a resurging interest in physical fitness occurred with respect to which the same benefits and advantages of weight training were also recognized.

As a result of this current wide range of interest in weight training, various types of weight training equipment have been developed which have received wide acceptance in many areas. Unfortunately, however, the high levels of sophistication and expense of such equipment usually restrict their installation to athletic clubs and facilities of well financed sports programs which are not readily available to many people. Accordingly, weight training is still practiced to a large extent in less sophisticated clubs and in the privacy of homes with equipment no more complicated than dumbbells and barbells, equipment which many, in any event, still consider more preferable for general physical fitness, as well as for preparation for weight lifting and body building competition.

In dumbbell and barbell weight training programs, a variety of weights are used in a variety of exercises each of which is designed to specifically develop, and enhance the appearance of, a particular muscle or group of muscles. One such exercise is referred to as the arm or biceps "curl", the purpose of which is to exercise and develop the biceps of the arm. In this exercise, the arm is caused to flex at the elbow so as to raise the forearm from a horizontal position to a vertical position while gripping a dumbbell of selected weight with the hand. This "curl" exercise can be practice by gripping a dumbbell in either hand separately or simultaneously, or by gripping a barbell with both hands. In practice, the exerciser usually conducts a number of "curl" repetitions, e.g., 8–10, which constitutes a "set", following which he completes similar "sets" of other exercises in his program each designed for a different muscle group, before returning again to the "curl" exercise. A number of "circuits" of the "sets", e.g., 3–4, usually constitutes a weight training program which is usually repeated three times a week.

In certain of the exercises usually included in a weight training program, the practice of the exercise often times places stress and strain on muscles of the body other than on the muscle or group of muscles that constitute the focus of the exercise. For example, in the "curl" exercise referred to above, considerable stress is placed on the wrist and forearm when flexing the arm, as well as on the fingers and palm of the hand simply by gripping the dumbbell. By virtue of these ancillary stresses placed on areas other than on the desired bicep of the arm, therefore, less than the full benefit that could be derived by the bicep muscle form the exercise is actually obtained. While this deficiency in certain weight training exercises has heretofore been recognized, there does not appear to have been any attempts made to alleviate the problem as, for instance, by providing some type of weight supporting device designed to lessen the ancillary stresses, as by being attached to the arm in the "curl" exercise. While there are in existence numerous types of devices for attachment to the arm, e.g., see U.S. Pat. Nos. 1,038,925, 1,851,011, 2,929,372, 3,370,302, 3,911,497, 4,011,596, and 4,062,073, all of such devices are intended for uses in conjunction with activities other than, and unrelated to, weight training.

SUMMARY OF THE INVENTION

There has continued to remain, therefore, a need for enhancing the benefits intended to be derived from weight training exercises designed for specific primary muscles, by relieving, or at least minimizing, ancillary stresses placed on secondary muscles in the performance of the exercise. It is a principal object of this invention to provide such enhancement. It is a further object of this invention to especially enhance the benefits and advantages derived from the weight training exercise known as the arm or bicep "curl", and exercises similar thereto. It is a still further object of this invention to provide a weight training device which reduces ancillary stresses to secondary muscles during weight training exercises while permitting, at the same time, the use of heavier weights more safely. Another object of this invention is to provide a weight training device attachable to the arm and to which can be attached a training weight, thereby reducing the stress usually encountered by the fingers and palm of the hand in gripping the weight, and by the wrist and forearm in lifting the weight. Further objects of the invention are to provide a weight training device simple in construction, inexpensive to manufacture, easy to use, and totally effective for its intended purpose.

These various objects are met in accordance with this invention by a weight supporting device comprising a rigid, splint-like member capable of bearing a load, and having a length such, that when placed against the underside of the forearm, it extends from a point below the elbow to a point adjacent the metacarpal-phthlangic joint of the hand. The device is shaped in lateral and longitudinal configuration so as to conform to the contour of the forearm, wrist, and base and palm of the hand, and is provided with means designed to extend about the forearm for securely attaching the device thereto. At a point along the length of the splint-like member aproximating the wrist, are provided means by which the grip of a weight training dumbbell, or the bar of a barbell, can be securely fastened to the supporting device. The end of the splint-like member terminating at the metacarpal-phthlangic joint may be appropriately curved to conform to the contour of the fingers when curled, and may be provided also with a rod for supporting the thumb.

DESCRIPTION OF THE DRAWINGS

In the drawings, which illustrate that which is presently regarded as the best mode for carrying out the invention.

DESCRIPTION OF THE PREFERRED EMBODIMENT

Figure 1:
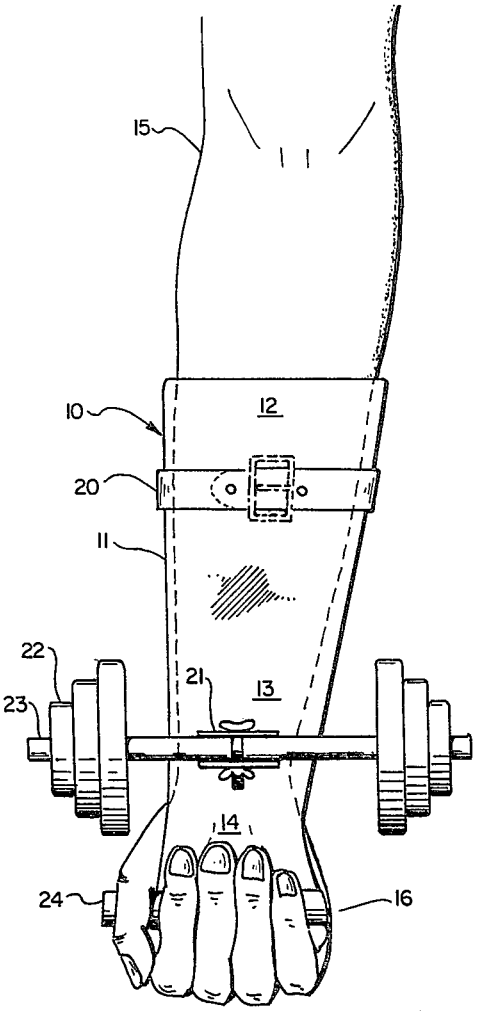
FIG. 1 is a pictorial representation of the weight training device according to this invention viewing the device in its secured position attached to the right arm of an exercising weight trainer, the device also having a dumbbell attached to it at approximately the area of the wrist.

Referring now to the figures of the drawings, a weight training device according to this invention and adapted to be attached to the underside of the right forearm of an exerciser, is indicated generally by reference numeral 10, and comprises a unitary, rigid, splint-like member 11 having forearm, wrist, and palm sections 12, 13, and 14, respectively. Splint-like member 11, when attached to the forearm, extends from a point sufficiently below the exerciser's elbow 15, shown in FIG. 1, so as to permit flexing of the arm, to a point adjacent the metacarpalphthlangic joint 16 in the palm of the hand. Along its longitudinal dimension, member 11 is shaped to fit the longitudinal contour of the limb to which it is attached, particularly at the base and palm of the hand, the shape of member 11 at these points being sculptured, as at numerals 17 and 18 in FIG. 3., palm section 14 further being curled as at curved element 19 so as to correspond to the contour of the fingers and hand as when gripping a rod. By virtue of the curvature of member 11 along its longitudinal dimension, the hand of the exerciser is caused to be fully supinated when member 11 is attached to the forearm. In its lateral dimension, splint-like member 11 essentially covers the forearm, wrist and palm of the exerciser, and, preferably, is shaped to conform to the lateral contour of the forearm and wrist. From forearm section 12, therefore, member 11 progressively decreases in its lateral dimension to a point at the wrist section where member 11 again increases in width to essentially cover the palm of the hand. Splint-like member 11 must be rigid and capable of bearing a load, i.e., a load in the form of a weighted dumbbell or barbell, and, accordingly, its material of construction must be commensurate with this demanded capability. For this purpose, steel plate, or any of various rigid plastic materials which may be reinforced as with fiberglass, may be employed.

Figure 2:
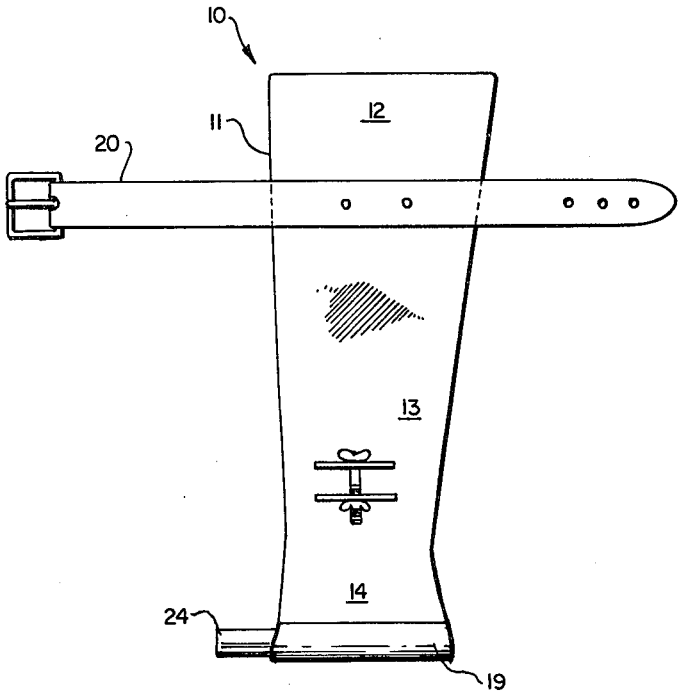
FIG. 2 is a plan view of the right arm weight training device of FIG. 1 viewing the same surface of the device as in FIG. 1.
Figure 3:
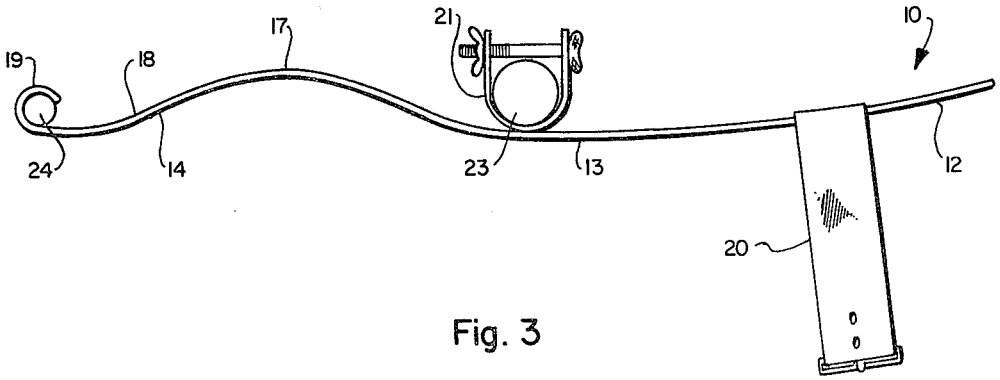
FIG. 3 is a side view of the weight training device of FIG. 1.

Associated with forearm section 12 are suitable fastening means 20 for securely attaching splint-like member 11 to the underside of the forearm of the exerciser. Fastening means 20 are depicted in FIGS. 1 and 2 as a single strap and buckle arrangement, but attachment of member 11 can just as well be effected by the use of snaps, hooks, Velcro tape, and the like, as well as by using more than the single fastening unit shown. For the comfort of the exerciser when wearing weight training device 10, splint-like member 11 may be lined on its inner surface along the length of forearm section 12 and wrist section 13 to the base of the hand, with a protective cushion of foam such as foamed rubber, foamed polyurethane, or the like. Also associated with splint-like member 11 at the wrist section 13 are means 21, shown in FIGS. 1 and 3, for securely attaching thereto a weight training means 22, such as a weight training dumbbell or barbell, by its grip or bar 23. Attaching means 21 must be capable of firmly securing and gripping bar 23 since, in using device 10, the exerciser has no hand control over weight 22, the hand being clasped firmly about curved element 19. Shown for this purpose in FIG. 3 is a collar and bolt arrangement, but other common fastening means such as straps in conjunction with buckles, toggles, hooks, snaps, and the like may be used as well as other fastening means such as Velcro tape. At the end of palm section 14 of splint-like member 11 and within the curved element 19, is a thumb rod 24 attached to and extending beyond the edge of palm section 14 on the thumb side of the exerciser's hand. Thumb rod 24 will normally be constructed of the same material as the rest of splint-like member 11 and may be extended through the length of curved element 19 to the non-thumb side of palm section 14. Thumb rod 24 serves as a means about which the exerciser may wrap the thumb of his hand when using weight training device 10.

In using the weight training device 10, splint-like member 11 is attached to the forearm of the exerciser through attaching means 20, and a dumbbell 22 of selected weight attached to member 11 by means of dumbbell rod 23 and attaching means 21. The exerciser grasps curved element 19 with his fingers and thumb rod 24 with his thumb and commences his exercise, e.g., an arm "curl", by flexing his arm through the elbow to raise and lower the forearm from the horizontal to the vertical, the exercise being repeated for a selected number of repetitions. By eliminating the exerciser's hand grip on bar 23 of weight 22 and by placing the weight 22 directly over the wrist so that its weight is evenly distributed over the base of the hand and the forearm, ancillary stress to the wrist and forearm muscles is reduced with the result that the muscle stress created by the "curl" is more fully directed to the intended bicep muscle of the arm.

Although the weight training device according to this invention has been described in its construction and in its use with respect to the right arm of an exerciser, such description has been for illustrative purposes only, since the invention obviously is just as adaptable to the left arm. Similarly, while the use of the weight training device has been described in conjunction with a single arm "curl" exercise, such description has also been for illustrative purposes only, since it should be recognized that the device is just as applicable for use in other upper body training exercises such, for example, as the two arm "curl" exercise for the bicep muscles, the "side and front lateral raise" exercises for the deltoid muscle, the "shoulder press" exercise for the deltoid, tricep, and trapezine groups of muscles, the "bent lateral raise" exercise for the upper back muscles, the "bent rowing" exercise for the latissimus dorsi muscle, and the "supine fly" exercise for the pectoralis muscle.

Reference in this disclosure to details of the specific embodiment described is not intended to restrict the scope of the appended claims, which themselves recite those features regarded as essential to the invention.

I claim:

1. A weight supporting device for attachment to the arm of an exerciser during weight training, which comprises: a rigid, load-bearing, splint-like means adapted to be attached against and to extend along the underside of the forearm from a point sufficiently below the elbow to permit flexing of the arm, to a point in the palm of the hand adjacent the metacarpal-phthlangic joint, said member terminating in an elongated upwardly turned element adapted to provide a cup-like grip for the fingers of a user; means for securely attaching said splint-like member against the underside of the forearm; and means for securely attaching a training weight to said splint-like member.

2. A weight supporting device according to claim 1 in which the splint-like member comprises forearm, wrist, and palm sections; the means for attaching the splint-like member to the underside of the forearm is associated with the forearm section; and the means for attaching the training weight to the splint-like member is associated with the wrist section.

3. A weight supporting device according to claim 2 in which said splint-like member is shaped in its lateral and longitudinal dimensions to conform to the contour of the forearm, wrist, and palm.

4. A weight supporting device according to claim 1 in which said upwardly curved element is provided with a thumb rod.

5. A weight supporting device according to claim 4 in which the splint-like member is cushioned on the surface adjacent the forearm.

* * * * *